United States Patent [19]

Hug

[11] Patent Number: 4,708,573

[45] **Date of Patent: * Nov. 24, 1987**

[54] APPARATUS FOR THE HANDLING OF METAL SHEETS

[75] Inventor: Peter Hug, Safenwil, Switzerland

[73] Assignee: Hammerle AG, Zofingen, Switzerland

[ * ] Notice: The portion of the term of this patent subsequent to Dec. 10, 2002 has been disclaimed.

[21] Appl. No.: 657,347

[22] Filed: Oct. 3, 1984

[30] Foreign Application Priority Data

Oct. 4, 1983 [AT] Austria ..... 3509/83

[51] Int. Cl.[4] ..... B21D 43/10; B21D 43/11

[52] U.S. Cl. ..... 414/589; 72/420; 72/422; 414/226; 414/751

[58] Field of Search ..... 414/749, 751, 744 R, 414/744 B, 744 C, 753, 589, 590, 222, 223, 225, 226, 677, 783, 684.3; 901/6, 16; 100/207, 215; 72/420, 419, 422

[56] References Cited

U.S. PATENT DOCUMENTS

| | | | |
|---|---|---|---|
| 4,005,782 | 2/1977 | Crockett | 901/16 X |
| 4,274,801 | 6/1981 | Herb et al. | 414/751 |
| 4,419,039 | 12/1983 | Bengtsson | 414/222 X |
| 4,557,135 | 12/1985 | Ragettli et al. | 72/420 |
| 4,573,861 | 3/1986 | Aschauer | 72/420 |

FOREIGN PATENT DOCUMENTS

| | | | |
|---|---|---|---|
| 2057515 | 6/1971 | Fed. Rep. of Germany | 72/422 |
| 100839 | 1/1979 | Japan | 72/422 |
| 48425 | 4/1980 | Japan | 72/386 |
| 144330 | 11/1980 | Japan | 72/420 |

*Primary Examiner*—Joseph E. Valenza
*Assistant Examiner*—David A. Bucci
*Attorney, Agent, or Firm*—Karl F. Ross; Herbert Dubno

[57] ABSTRACT

A device for handling metal sheet workpieces for a bending press or other metal-working machine has a pair of vertical plates which are movable along the front of the press and are spanned by guide columns upon which respective slides are movable vertically to carry the tongs. A turntable on the press allows rotation of the plates about horizontal axes in the vertical plane.

17 Claims, 8 Drawing Figures

APPARATUS FOR THE HANDLING OF METAL SHEETS

FIELD OF THE INVENTION

My present invention relates to an apparatus for the handling of metal sheet, more particularly, to an apparatus associated with a metal-working machine, e.g. a bending, stamping, punching or forming press, which is capable of handling metal plates, panels or sheets, collectively referred to herein as metal sheets.

BACKGROUND OF THE INVENTION

The shaping of metal sheets on modern metal-working machinery is generally carried out automatically and with preprogramming of the machine so that the metal sheet automatically is subjected to a sequency of pressing steps which may bend, deform, stamp, punch or otherwise configure the workpiece to the desired profile.

A disadvantage of earlier machines for this purpose is that during the profiling, i.e. the successive bending operations, the metal sheet must be supported or braced by various auxiliary forces or means. This is especially the case with large and heavy metal plates which are intended to be profiled by a bending press. The handling of metal sheets in these cases is complex and laborintensive.

It has already been proposed to provide a manipulating device for metal plates, especially edge-bending presses and which is capable of handling all of the heavy and cumbersome workpieces which may have had to be manipulated heretofore and especially heavy and large metal sheets and plates under the control of a single worker without auxiliary devices or with auxiliary devices only in particularly difficult cases. Such manipulators can automatically and in minimum time orient the metal sheets in all necessary positions so that various types of edge-bending operations can be carried out.

A manipulator of this type has a pair of rotatable tongs which can cooperate with sheet supports and which can engage the metal sheet laterally. The sheet tongs or pinchers can be movable in three dimensions and to this end a pincer guide is provided which can be moved up and down in a horizontal slide, the latter being mounted on a further slide so as to be shiftable in the horizontal direction with two mutually perpendicular components.

OBJECTS OF THE INVENTION

It is the principal object of this invention to provide an improved metal sheet handling device which has the advantages of the last-mentioned mechanism but is more versatile and efficient than the latter. Another object of the invention is to provide a metal-handling device for the purposes described which is more efficient to use and which requires less labor and effort than earlier devices.

SUMMARY OF THE INVENTION

The device according to the invention also has a pair of rotatable tongs and pincers which cooperate with sheet supports and engage the metal sheet laterally and which can be shifted in three dimensions. In the device of the invention, however, on the front side of the metal-working machine in planes perpendicular to the frontal plate, two carriers are provided and each carrier is formed with a guide shiftable in the plane of the carrier and which receives a vertically displaceable holder for a respective tong or pincer.

It has been found to be advantageous to form each of the carriers as a U-frame with the carrier itself being shiftable along the shank ends of this frame. According to another feature of the invention, the shiftable guide is received between the shanks of the U-shaped carrier and is formed as a guide column provided with a gripper slide forming the holder for the respective pincer and with a beam slide for receiving a support beam. On the front side of the metal-working machine, moreover, a rotary turntable mechanism is provided which forms a rotary holder for retention of the workpiece to be manipulated in the vertical position generally to the frontal plane and for rotating the latter in this plane about an axis which is horizontal and is perpendicular to the frontal plane.

BRIEF DESCRIPTION OF THE DRAWING

The above and other objects, features and advantages of the present invention will become more readily apparent from the following description, reference being made to the accompanying drawing, in which.

SPECIFIC DESCRIPTION

Figure 1:
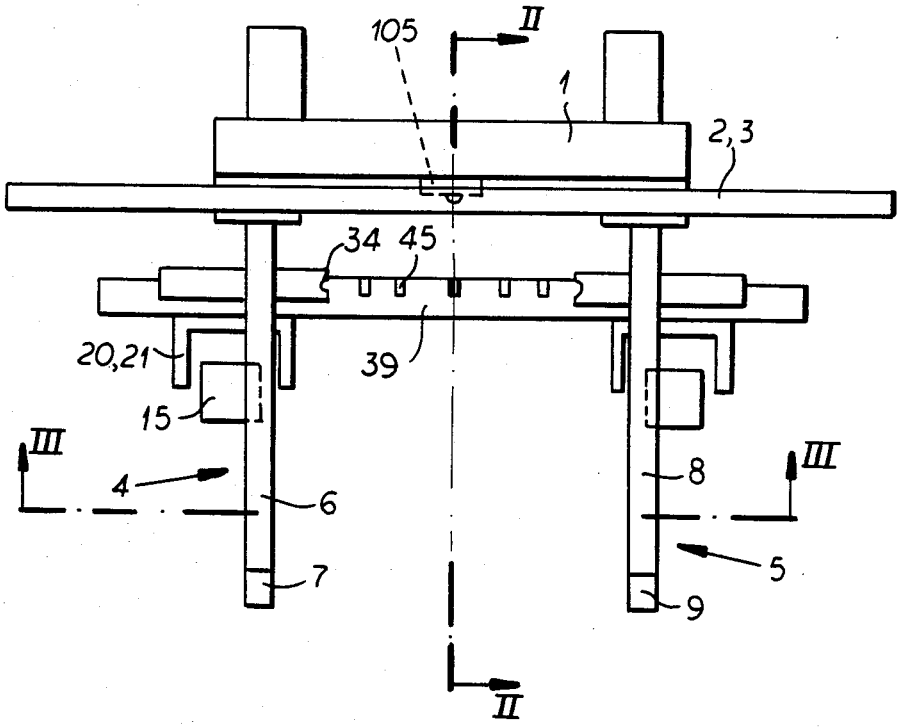
FIG. 1 is a plan view diagrammatically illustrating the device according to the invention.
Figure 2:
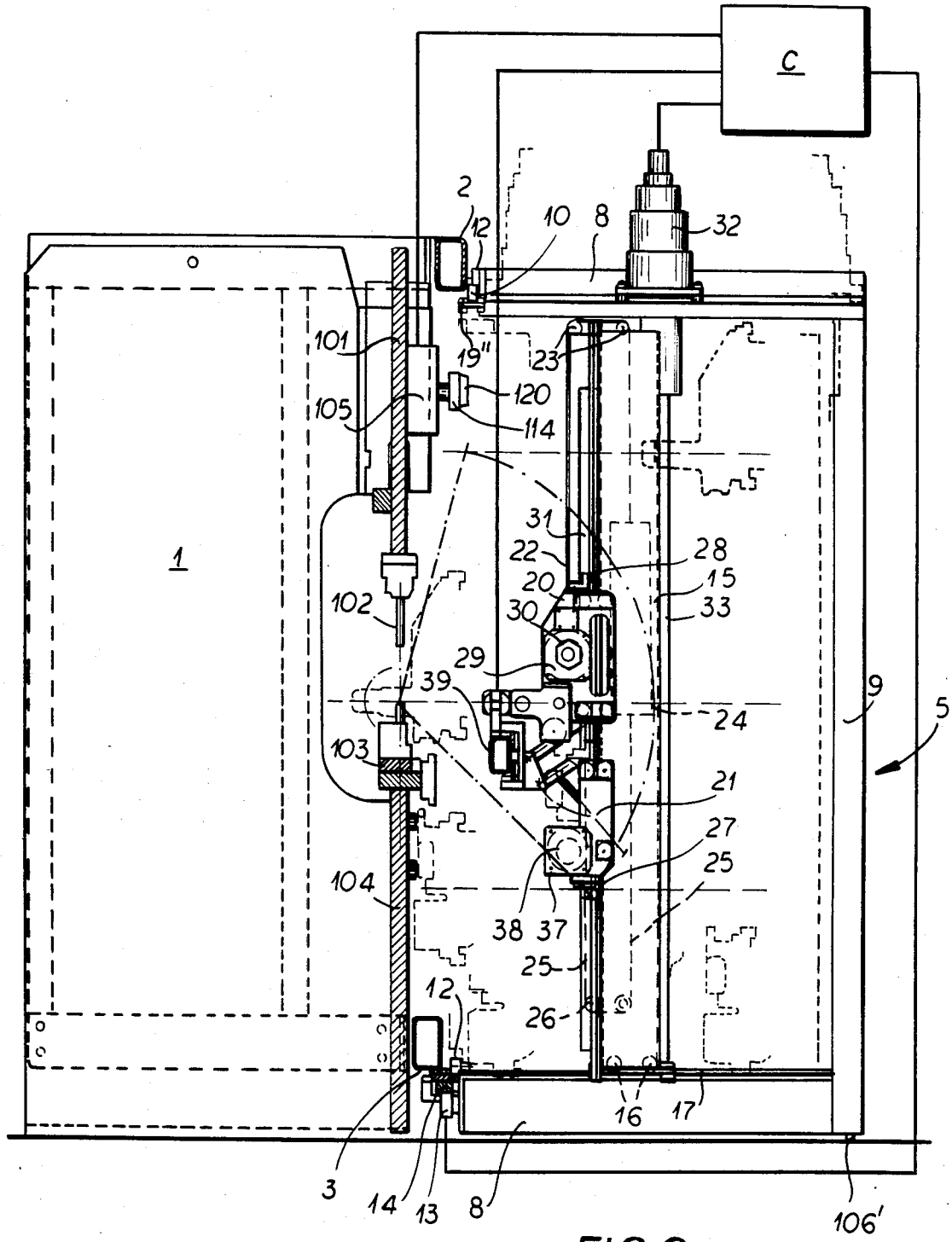
FIG. 2 is a section taken along the lines II—II of FIG. 1.

FIGS. 1 and 2 show a conventional sheet bending press 1 which can be utilized for the edge-bending of workpieces in the form of metal plates or sheets. The press 1 comprises a ram 101 having an upper tool 102 which cooperates with a lower tool 103 mounted on the frame 104 of the press.

The tools 102 and 103 can be utilized to impart to the metal sheet any desired profiling, usually in accordance with a predetermined program, to which end the press can be equipped with a computer for monitoring and controlling the successive shaping steps.

On the front side of the press, at upper and lower portions thereof, respective main carriers 2 and 3 are provided, the main carriers being constituted as horizontal beams. On the arm 101, a rotating device 105 is provided.

The beams 2 and 3 extend horizontally and at at least as large as the length of the press at the front side. As can be seen from FIG. 1, the beams 2 and 3 more generally extend beyond the ends of the press on both the right and left hand sides thereof.

A pair of U-shaped frames 4 and 5 are provided as well, these U-shaped frames being open horizontally while lying in vertical planes so that they can also be considered to have the configuration of reverse-C frames.

Each frame comprises a lower and an upper horizontal carrier 6 and 8, respectively, and a vertical carrier 7 or 9, each of these carriers being a respecitve beam which forms a shank of the respective frame.

As can be seen from FIG. 1, these frames open toward the press and are horizontally spaced apart so that they lie practically opposite the two ends of the press.

Consequently, as seen from FIG. 1, the left-hand frame 4 comprises the two horizontal carriers 6 and the vertical beam 7 while the right-hand frame 5 comprises the two horizontal beams 8 and the vertical beam 9.

As can be seen from FIG. 2, the horizontal beams 2, 3 lie substantially at the level of the upper and lower main beams 8 so that the entire frames can be shifted along these main beams 2 and 3.

FIG. 2 also shows that the C-shaped frame 5 is connected at its open end at the upper and lower beams to the upper and lower main beams 2 and 3 so as to ride upon the latter while the rear part of the frame, below the upright, is supported by a roller 106' on the ground or floor.

The C-shaped frame 4 similarly rides along the beams 2 and 3 and can be supported by a corresponding roller.

Figure 3:
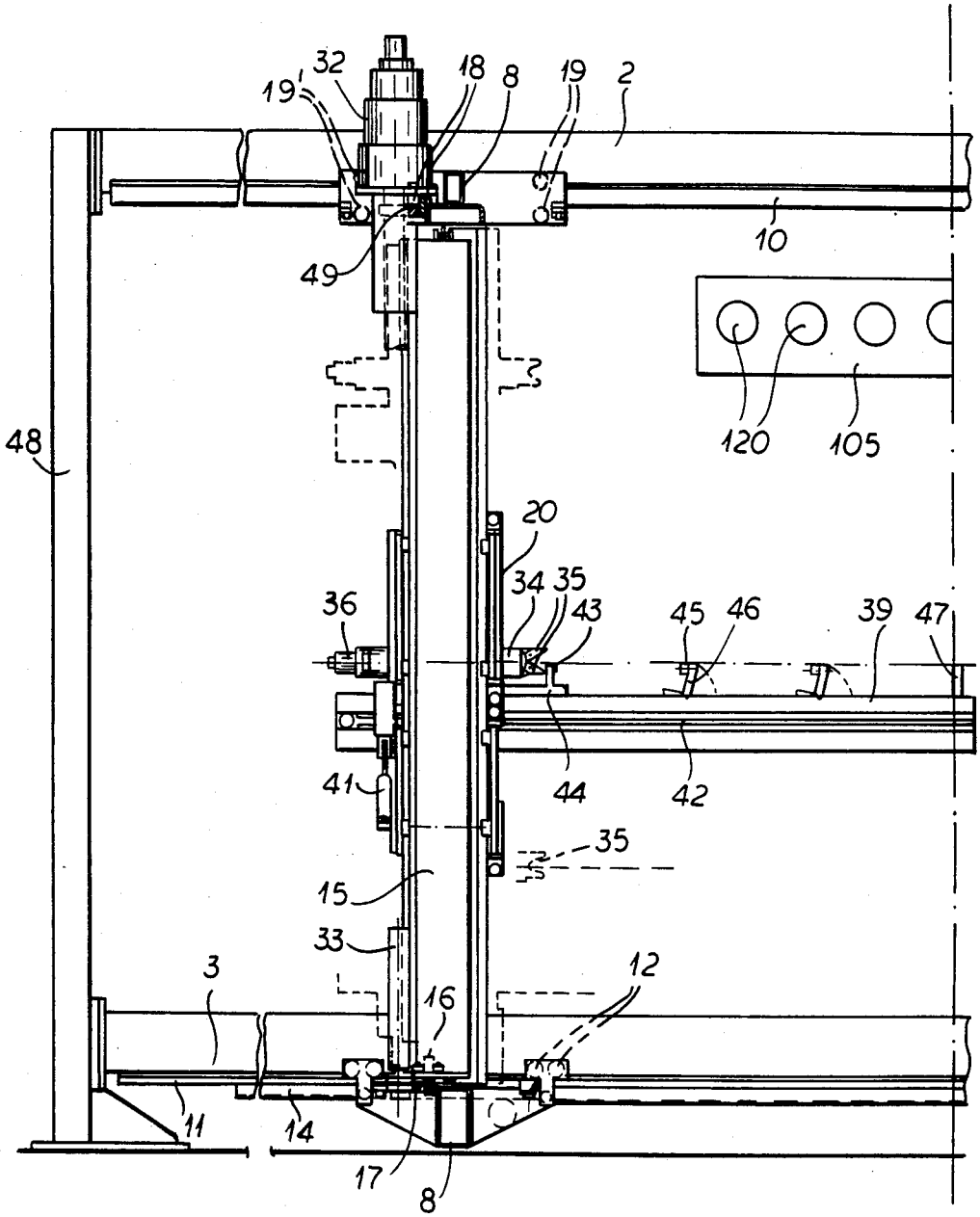
FIG. 3 is a section taken along the lines III—III of FIG. 1.

The main beams 2 and 3 can be mounted directly on the frame 104 of the press or can be supported on separate uprights or supports disposed laterally of the press as shown at 48 in FIG. 3. Whether the rails 2 and 3 are supported on the press alone or additionally on the supports 48, they are provided with rails 10 and 11 upon which the beams 6 and 8 ride via rollers 12.

Preferably a pair of rollers 12 are mounted on the right and left hand sides of the rail for each of the beams 6, 8. A driven pinion 13 can engage in a rack 14 (FIG. 2) which can be provided along the underside of the main beam 3 so that the frames can be driven along the length of the front side of the press.

In each of the two C-shaped frames 4 and 5, between the horizontal beams 6 and 8 thereof, respective vertical guide columns 15 are mounted. Each column has a guide roller 16 on the bottom thereof to allow the vertical column to ride upon the lower beam 6 or 8 of the frame and thus to move toward and away from the front of the press. The roller 16 rides upon a rail 17 formed by or disposed along the horizontal lower beam 6 or 8. Each column 15 is also prevented from tilting by roller 16 at the upper end thereof engaging a track or rail 49. From FIGS. 2 and 3, additional rollers 19' and 19" are visible which provide additional upper guidance for the rail for the column in the respective C-shaped frame.

Each of the guide columns 15 is provided with a gripper slider or carriage 20 which is vertically movable on the column and is located above a beam side or carriage 21. The carriages 20 and 21 are coupled together and are displaced by means of an upper chain 22 passing over rollers or sprockets 23 and connected to a counterweight 24 which is also tied by a lower chain 25, passing below the idler rollers or sprockets 26, with the beam carriage 21. The beam carriage 21 is guided on the column 15 by rollers 27 whereas the gripper carriage 20 is guided on rollers 28. For vertical displacement of the gripper carriage 20 along the column 15, a hydraulic motor is mounted on this carriage as can be seen at 29 and drives a pinion 30 meshing with a rack 31 in the column 15.

The column 15 is displaced along the rail 17 by a motor 32 which is disposed in the region of the upper horizontal beam 8 and via a shaft 33 is connected with the guide rollers 16. The gripper carriage 20 is provided with one pincer 34 (FIG. 3) while another pincer is analogously provided upon the column 15 of the other frame 4.

Pincer 34 (FIG. 3) comprises gripping shoes 35 and can be rotated by a hydraulic motor 36 about a horizontal axis parallel to the frontal plane of the press. The hydraulic motor 36 is a high-torque motor and rotates with low speed. The details of the pincer or tongs 34 will be developed below with respect to FIG. 4.

The beam carriage 21 is provided with a hydraulic motor 37 driving a pinion 38 meshing with the rack 31. In addition, a support beam 39 is provided to extend between the columns 15 horizontally below the tongs 34 and which is fastened by outriggers 40 on the beam carriage 21.

Figure 2A:
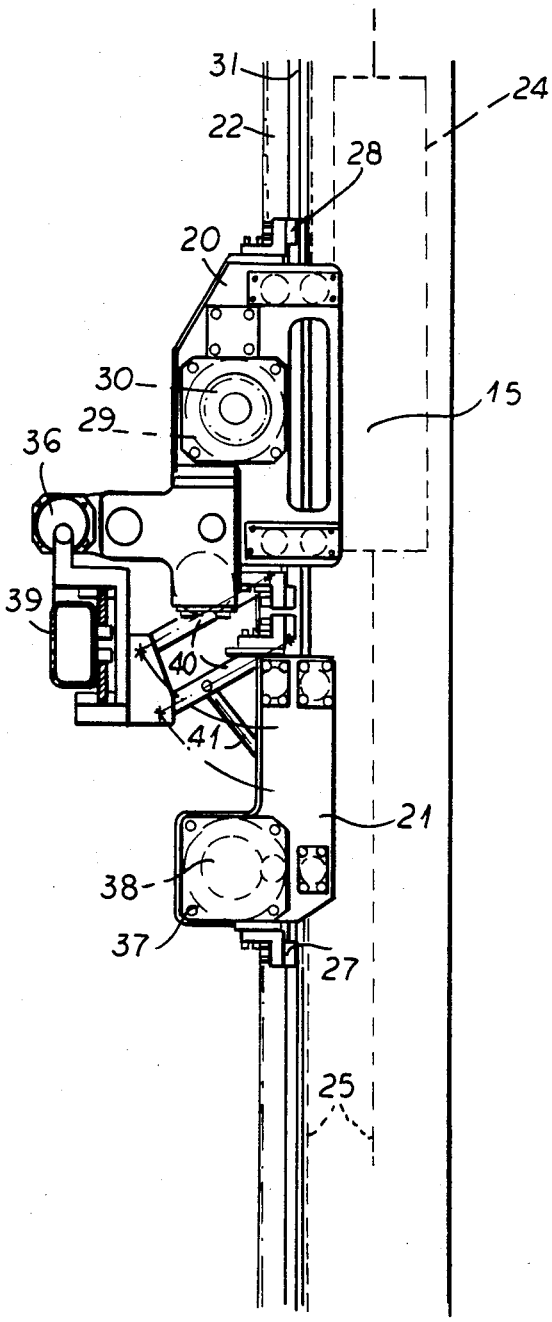
FIGS. 2A and 2B are elevational views of portions of FIG. 2 in two different operating regions.
Figure 2B:
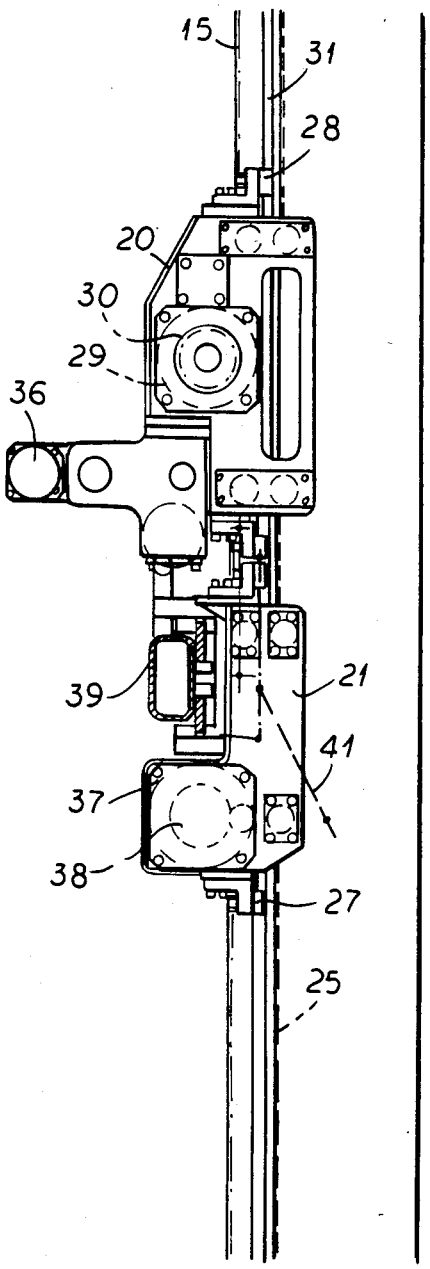

The arrangement is such that a support beam 39 can be swung from its normal position shown in FIGS. 2 and 2A into an off-normal position as shown in FIG. 2B in which the support beam no longer lies in the region of the tongs 34 but rather lies adjacent the column 15 so that the tongs 34 can be moved very close to the press front. The swinging of the support beam 39 can be effected hydraulically or pneumatically via locks 41 which are pivotally connected to the outrigger 40 and the column 15.

In the support beam 39, a centering chain drive 42 is provided. This chain drive 42 serves to maintain a horizontal orientation of the support beam 39 so that it ensures a symmetrical orientation of the two guide columns.

Directly ahead of the pincer jaws 35 of the tongs 34 and at the same level, a support roller 43 is provided.

The support roller 43 is mounted on a holder 44 which follows the movement of the tongs 34 along the support beam 39. Further support rollers can be journaled along the support beam 39 or swingable supports 46 which can be spring-biased or biased by counterweights so that they have the position illustrated in FIG. 3, can be provided.

The vertical guide columns 15 can be moved toward or away from one another along the support beam 39, i.e. horizontally by a corresponding movement of the respective frames, and to permit this the roller supports 46 are swung out of the way in the counterclockwise sense from their positions shown in FIG. 3.

At 47 I have shown a fixed support roller located in the middle of the support beam 39.

Figure 4:
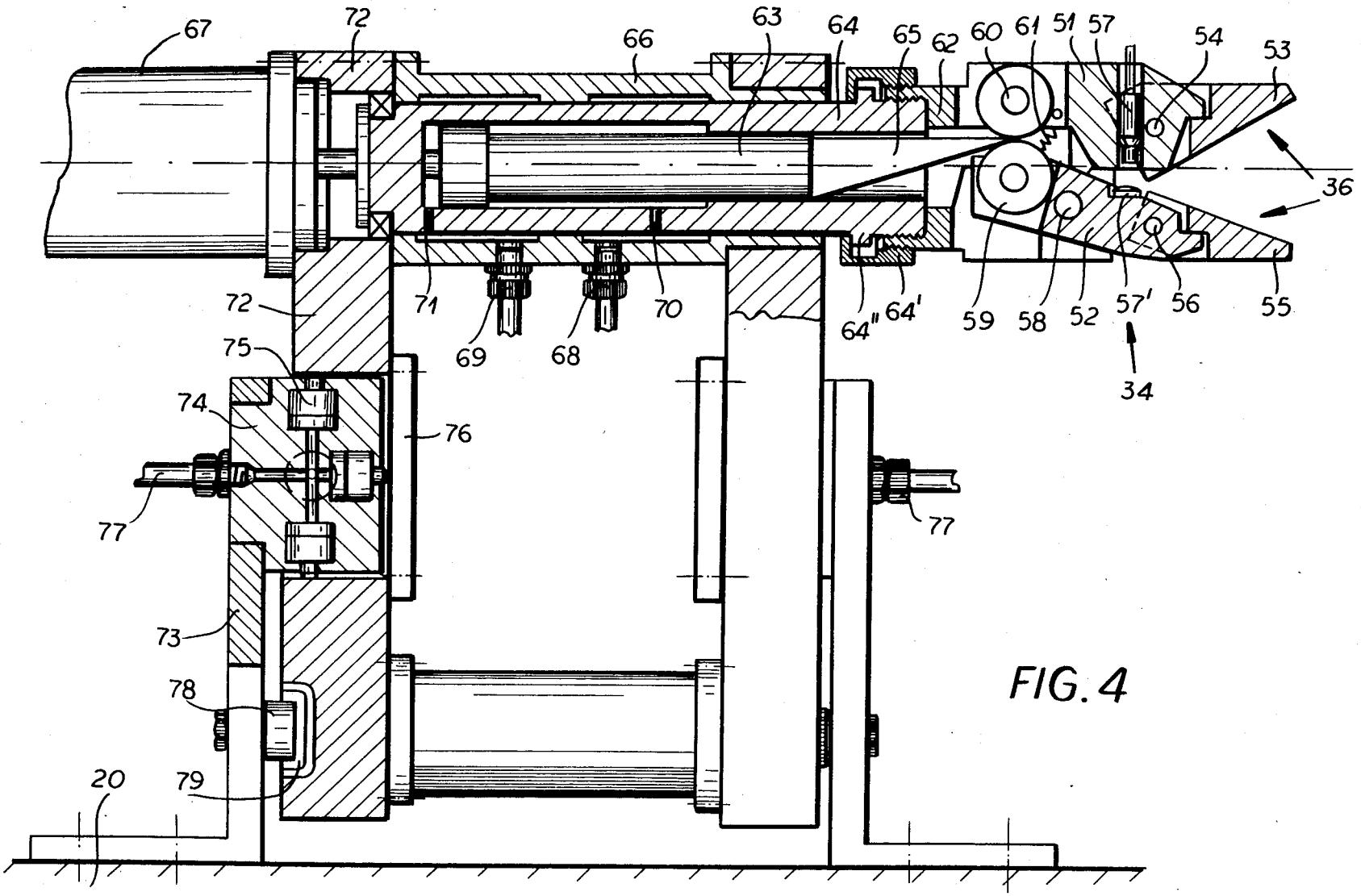
FIG. 4 is an enlarged partially sectional view illustrating a detail of the pincer.

From FIG. 4 the construction of the tongs 34 and the gripper jaws 35 will be apparent. The gripper jaws include a fixed frame portion 51 and a movable jaw portion 52. The jaw portion 51 is provided at its end with one pincer half 53 which is swingable about a pin 54 and cooperates with the pincer half 55 of the movable frame portion 52.

The pincer half 55 is also pivoted on a pin 56. The two pincer halves 53 and 55 are spring-biased to deflect the upper pincer half 53 into the position shown. The jaw portion 52 can also be biased into the position shown in FIG. 4 by a spring. Since the pincer members 53 and 55 are pivotal, they can assume orientations and positions enabling them to assume the form of the metal sheet which is to be gripped.

To signal whether a metal sheet is engaged in the tongs or not, a light curtain is provided.

The light curtain can be formed by a light beam transmitter 57 in the jaw part 51 and a detector or sensor 57' in the movable jaw part 52.

The moveable jaw part 52 is pivotal about a pin 58 and is provided on its end turned away from its pincer 55, with a cam follower roller 59 cooperating with a guide roller 60. A tension spring 61 biases the jaw part 52 into its open position.

The jaw halves 51 and 52 are provided with a collar 62 which can be threaded onto a cylinder 64 and which in turn is threadably engaged by a locking sleeve 64' braced against a shoulder or flange 64''. Via the cylinder 64, the frame halves 51 and 52 with the collar 62 are rotatable about the longitudinal axis of a housing 66 receiving the cylinder 64.

To close the tongs, the frame part 52 is swung about the pin 58. For this purpose, a piston 63 is provided in the cylinder 64 and carries a wedge 65 which can pass between the rollers 59 and 60. Upon displacement of the piston 63 in FIG. 4 from the left to the right, the wedge 55 swings the roller 59 in the counterclockwise sense.

As previously noted, the cylinder 64 is rotatable in the housing 66 by a drive motor axially aligned therewith and represented, together with any speed-reducing gearing, by the reference numeral 67. This rotary drive can rotate the cylinder 64 through 360° in both directions.

The cylindrical housing 66 is connected with fluid pressure fittings 68 and 69 which communicate via bores 70 and 71 through the wall of the cylinder 64 where the working spaces or opposite sides of the piston 63 are provided.

The tongs 51, 52, together with their actuating means 63–67, are mounted via two cylindrical holders 72 upon a pair of guide arms 73 which, in turn, are connected with the gripper carriage or slide 20. The arms 73 carry guide rollers 78 which are received in a track 79 of the respective holder 72.

Between the two arms 73 and the associated holders 72, respective housings 74 are provided in which four fluid pressure cylinders 75 with respective pistons are disposed in a star arrangement.

The housing 74 is so arranged in the cylindrical holder 72 that when the pistons of the cylinder 75 are forced outwardly by fluid pressure, the holder 72 is locked to the arm 73 so that between the carriage 20 and the holder 72 a rigid connection is formed.

When the pistons of cylinder 75 are retracted, between the housing 74 and each holder 72 there is sufficient play to enable relative movement.

The carriage 20 and the arm 73 are controlled by the computer to impart a swinging movement to the respective tongs about the axis of a cylinder and hence in a circular arc.

Because the metal sheet is a comparatively stiff member, a fixed relationship of the tongs, the arms and the carriage may give rise to certain stresses in the sheet metal when the latter is clamped in the tongs and subjected to deformation in the press. Because of the play which is permitted between the holder 72 and the arm 73, when the sheet metal is placed in the press, the cylinders 75 can be relieved and only locked when it is certain that self-adjustment of the sheet metal has eliminated the stress.

The fluid pressure lines for supplying these cylinders has been shown at 77 and the enlargement for the housing 74 with the plate 72 can be closed by a cover 76 bolted to the plate or the housing 74. The cover 76 limits axial displacement of the housing 74 on the plate 72.

Figure 5:
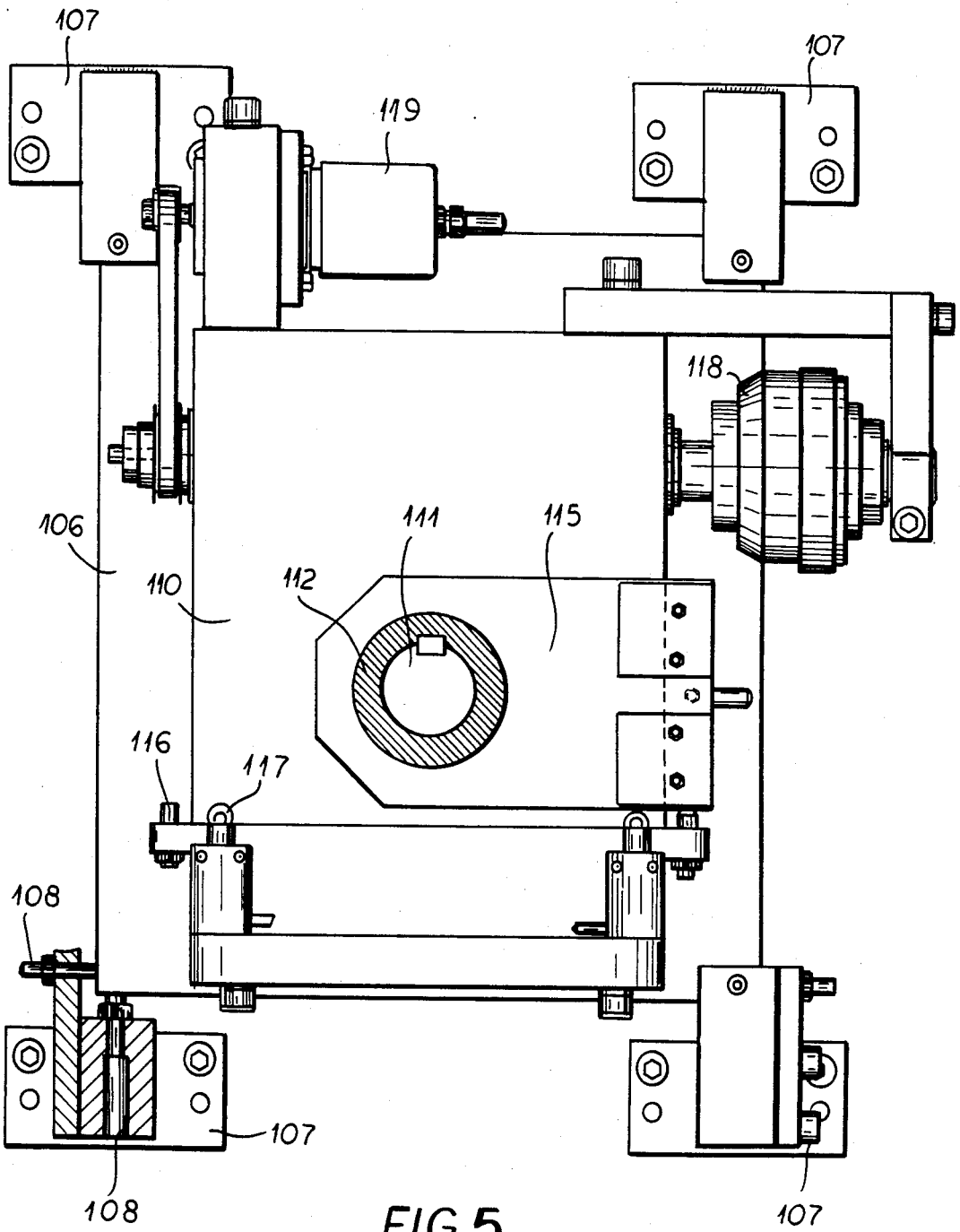
FIG. 5 is an enlarged front elevational view showing a part in section.
Figure 6:
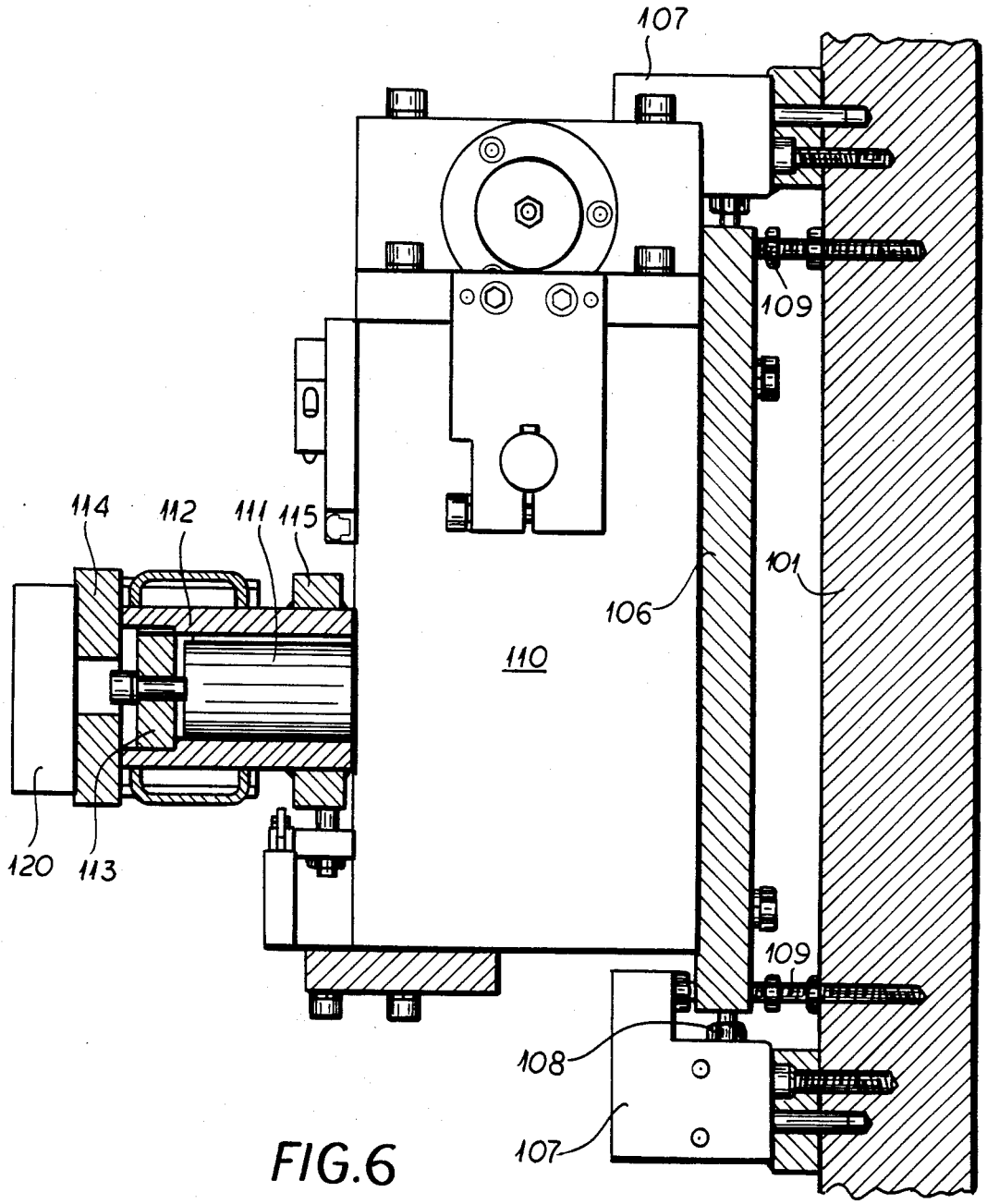
FIG. 6 is a vertical section through the turntable of the rotating device.

FIGS. 5 and 6 show the rotating device 105 in greater detail. This rotating unit is mounted on the arm 101 of the press and can be seen in FIG. 5 in front elevation and in FIG. 6 in a partial vertical section. The rotating device or turntable 105 comprises a base plate 106' which is adjustably affixed by brackets or other holder elements 107 onto the arm. The brackets 107 engage over the corners of the base plate and are provided with spacer screws capable of precisely adjusting the base plate as to orientation and distance with respect to the ram. Further tension or compression bolts 109 can fix the base plate in its adjusted position.

The base plate 106 carries a housing 110 provided with a worm drive whose worm gear shaft has been represented at 111. The one shaft 111 extends substantially perpendicular to the base plate 106 and hence to the arm 101 while projecting from the housing 110 and being formed with a hub 112 which is connected thereto by a retaining disk 113.

At the outer end of the hub 112, a mounting plate 114 is fastened. The hub 112 is also connected to an abutment lever 115 which precisely limits the rotation of the shaft 112. The mechanism establishing the limits for the rotation of the abutment lever 115 is adjustable and can include abutments 116 and switches 117 capable of turning off the drive motor or resetting the drive motor when the turntable has reached one of its two opposite limiting positions.

The drive motot has been represented at 118 and is laterally flanged to the housing 110. Of course, in place of the described limits utilizing the abutment lever 115, an electronic control of the angular displacement generated by the motor 118 can be provided using conventional circuitry. In this case, an additional transmitter, i.e. a position measuring pulse-generating sensor 119 for the instantaneous angular orientation of the rotating device generated by motor 118 can be connected to the housing 110 to provide the input to the circuit, the switches 117 and the lever 115 being then omitted.

The heading plate 114 is formed as a bar which extends horizontally in its rest position along the press. A plurality of magnets 120 can be mounted on this heading plate 114 which can be electrically energized to annul their magnetic effects. Instead of the electrically canceled magnetic means, I may use suction or gripper devices operating by action of a vacuum to hold the workpiece.

The magnets 120 can support a sheet metal workpiece to enable it to be rotated about an horizontal axis perpendicular to the workpiece as will be described subsequently.

The sheet metal workpiece to be deformed in the press is delivered to the press in an approximately vertical orientation by an appropriate transporter or carriage which has not been illustrated and is engaged in the tongs 34. Along the bottom of this carriage, upon which the lower edge of the sheet metal plate can rest, a reference surface is thus formed relative to which the tongs 30 can be oriented and positioned. For this purpose, the two vertical guide columns 15 are so maneuvered that the open jaws 35 of the tongs 34 engage over the edge of the plate and grip the latter as soon as the edge enters the mouth of the pincer.

By displacement of the piston 63, the pincers are closed and the sheet metal plate held in the vertical position. By movement of the two carriages 20 upwardly relative to the reference surface, the plate is lifted. The rotary drive 67 is then actuated to swing the plate into a horizontal position until the plate is supported by rollers 43, 45 and 47.

Then the two columns 15 together with the metal plate and the rollers 43, 45 and 47 on which the plate is braced are moved in the horizontal direction toward the arm 101 of the press 1 at a level to position the plate between the upper and lower tools 102 and 103 of the press. For exact positioning of the plate, the closing force of the pincer is reduced and the plate is accurately positioned between the tools. For edge bending the tongs 34 can describe a precalculated swinging movement which is determined by the computer and controlled by the computer. Any stresses in the sheet resulting from deviations from the ideal are compensated by the play provided when the cylinders 75 are relieved to allow the holder 72 to move and yield somewhat.

Any relative movement between the movable part of the pincer and the fixed or rigid part upon which it is supported can be electrically measured and the resulting differences introduced as corrections in control by the computer of subsequent bending operations.

If bending is to be effected on the three other sides of the plate, the latter is rotated by the tongs 34 again into the vertical position and by shifting of the columns 15 on the rail 17 and by raising the gripper side 30, the plate is brought onto the turntable 105 where it is engaged to the magnets 120, whereupon the tongs 34 are opened and the columns 15 retracted (FIG. 3) to the left.

The motor 118 is energized to rotate the plate in its vertical plane with the angle of rotation being exactly set or programmed. The plate is then engaged again by the tongs 34 and the force of magnets 120 cut off. The plate is then rotated into the horizontal position and again fed between the tools of the press. The press can be continued for as many bends as required. If small strips of metal are to be handled, requiring the tongs 34 to be brought closer to the tools 102, 103, the support beam 39 is swung via the outriggers 40 into the positions shown in FIG. 2B so that the columns 15 can approach the press more closely. This position has been represented in broken line in FIG. 2.

By movement of the C-shaped frames 4 and 5 along the front of the press 1, by movement of the columns 15 and by movement of the tongs 34 in the vertical direction and corresponding movement of the beam 39, the jaws 35 cannot only be brought into any desired position but can be moved in a simple and highly precise manner by computer control. The computer has been represented at C in FIG. 2 and has only diagrammatically been illustrated to be connected to the several elements controlled thereby. It will be understood, of course, that any of the other or drives described can be operated by the computer as well. The turntable 105 allows the plate to be rotated about a horizontal axis perpendicular to the frontal plane of the press and permits reorientation of the plate.

I claim:

1. An apparatus for positioning a metal sheet workpiece in a metal-working machine having a front side and comprising in combination with said machine:

a pair of vertical frames lying in respective vertical plane parallel to one another and perpendicular to said front side of said machine;

means for enabling the displacement of said frames horizontally perpendicular to said planes;

respective vertical guides on said frames;

respective tongs engageable with said workpiece;

means for vertically displacing said tongs on said guides, each of said frames being generally C-shaped, being open in the direction of said front side and having upper and lower shanks extending toward said machine, said front side of said machine having horizontal beams engageable with the upper and lower shanks of each of said frames for guiding said upper and lower shanks for horizontal movement parallel to said front side, said vertical guides of the respective frames being mounted on the upper and lower shanks of the respective frame; and means for mounting said upper and lower shanks for said horizontal movement parallel to said front side along said horizontal beams.

2. The machine defined in claim 1 wherein each of said vertical guides is a vertical column mounted to ride on said upper and lower shanks horizontally in a direction parallel to the respective plane and perpendicular to said front side, each of said tongs being mounted on a respective carriage vertically shiftable along the respective column.

3. The apparatus defined in claim 2 wherein each of said carriages is provided with a beam support, said beam supports being spanned by a support beam provided with means for supporting said workpiece between said tongs.

4. The apparatus defined in claim 3 wherein said support beam is swingably mounted on said beam supports by respective outriggers.

5. The apparatus defined in claim 2 wherein between each of said tongs and the respective carriage, there is provided an intermediate member including respective holders for the respective tongs which can be locked to form a rigid connection therebetween and released to provide play adapted to relieve stress in the workpiece.

6. The apparatus defined in claim 5 wherein each of said intermediate members includes a housing receiving a plurality of fluid-operated cylinders adapted to brace against the holders for the respective tongs.

7. The apparatus defined in claim 6 wherein each of said holders is swingable with respect to a respective arm projecting from the respective carriage and each of said arms has a roller guide in the respective holder, said housing being received in an opening in the respective holder.

8. The apparatus defined in claim 6, further comprising means responsive to play between said housing and said holder, for measuring said play and a computer responsive to the measured play for correcting the control of the movement of said tongs.

9. The apparatus defined in claim 2 wherein each of said tongs includes a nonswingable jaw and a swingable jaw and a wedge member receivable between rollers carried by said jaws for opening and closing the tongs.

10. The apparatus defined in claim 9, further comprising means for rotating each of said tongs on said carriage about an axis perpendicular to the respective column.

11. An apparatus for positioning a metal sheet workpiece in a metal-working machine having a front side and comprising in combination with said machine:

a pair of vertical frames lying in respective vertical plane parallel to one another and perpendicular to said front side of said machine;

means for enabling the displacement of said frames horizontally perpendicular to said planes;

respective vertical guides on said frames;

respective tongs vertically displaceable on said guides and engageable with said upper and lower shanks of each of said frames for guiding said upper and lower shanks for horizontal movement parallel to said front side, said vertical guides of the respective frames being mounted on the upper and lower shanks of the respective frame, each of said guides being a vertical column mounted to ride on said upper and lower shanks horizontally in a direction parallel to the respective plane and perpendicular to said front side, each of said tongs being mounted on a respective carriage vertically shiftable along the respective column, each of said carriages is provided with a support beam swingably mounted thereon, and means for swinging said beam for movement between a position in which said support beam is swinging toward said front side of said machine and a position wherein said support beam is swung back from said machine, said support being provided with supporting members for said workpiece between said tongs; and means for vertically shifting said carriages along the respective columns.

12. An apparatus for positioning a metal sheet workpiece in a metal-working machine having a front side and comprising in combination with said machine:

a pair of vertical frames lying in respective vertical plane parallel to one another and perpendicular to said front side of said machine;

means for enabling the displacement of said frames horizontally perpendicular to said planes;

respective vertical guides on said frames;

respective tongs vertically displaceable on said guides and engageable with said workpiece, each of said frames being generally C-shaped, being open in the direction of said front side and being formed with upper and lower shanks extending toward said machine, said front side of said machine having horizontal beams engageable with the upper and lower shanks of each of said frames for guiding said upper and lower shanks for horizontal movement parallel to said front side, said vertical guides of the respective frames being mounted on the upper and lower shanks of the respective frame, each of said guides being a vertical column mounted to ride on said upper and lower shanks horizontally in a direction parallel to the respective plane and perpendicular to said front side, each of said tongs being mounted on a respective carriage vertically shiftable along the respective column;

means for mounting said upper and lower shanks for said horizontal movement parallel to said front side along said horizontal beams;

a turntable mounted on said front side of said machine and provided with means for receiving said workpiece in a vertical orientation thereof and rotating said workpiece in a vertical plane; and means for vertically shifting said carriages along the respective columns.

13. The apparatus defined in claim 12 wherein the means for receiving said workpiece in a vertical plane comprises a bar provided with a plurality of releasable holders for engaging said workpiece.

14. The apparatus defined in claim 13 wherein said releasable holders are magnets having annullable magnet fields.

15. The apparatus defined in claim 13 wherein said bar is connected to a shaft of a transmission having adjustable angular displacement about a horizontal axis.

16. The apparatus defined in claim 15, further comprising an angular stroke-determining lever mounted on said shaft, adjustable stops cooperating with said lever for limiting the angular displacement of said shaft, and respective switches responsive to the displacement of said lever.

17. The apparatus defined in claim 15 wherein said transmission is provided with additional sensors for electronic control of the rotation of said shaft.

* * * * *